United States Patent [19]

Spier

[11] Patent Number: 4,999,599

[45] Date of Patent: Mar. 12, 1991

[54] MAGNETIC SWITCH AND LATCH FOR VEHICLE ACCESSORIES

[75] Inventor: Eric A. Spier, Lake Orion, Mich.

[73] Assignee: Irvin Automotive Products, Inc., Auburn Hills, Mich.

[21] Appl. No.: 512,733

[22] Filed: Apr. 20, 1990

[51] Int. Cl.[5] ..... H01H 9/00

[52] U.S. Cl. ..... 335/207; 335/205

[58] Field of Search ..... 335/205–207

[56] References Cited

U.S. PATENT DOCUMENTS

| | | | |
|---|---|---|---|
| 3,239,658 | 3/1966 | Castaldo, . | |
| 3,560,846 | 2/1971 | Bessko . | |
| 3,739,117 | 6/1973 | Melton . | |
| 3,758,262 | 9/1973 | Harris . | |
| 3,890,476 | 6/1975 | Canter . | |
| 4,025,885 | 5/1977 | Giannini | 335/206 |
| 4,186,362 | 1/1980 | Kondo et al. . | |
| 4,274,070 | 6/1981 | Thiene . | |
| 4,409,576 | 10/1983 | Petersen | 335/207 |
| 4,481,389 | 11/1984 | Johnson . | |
| 4,596,971 | 6/1986 | Hirabayashi et al. . | |
| 4,820,888 | 4/1989 | Shields . | |
| 4,837,539 | 6/1989 | Baker . | |
| 4,866,426 | 9/1989 | Evans . | |

*Primary Examiner*—Leo P. Picard
*Assistant Examiner*—Lincoln Donovan
*Attorney, Agent, or Firm*—Harness Dickey & Pierce

[57] ABSTRACT

A magnetic switch assembly for an electrical circuit includes a switch housing with a cavity formed therein and at least one magnetically attractable electrical contact member exposed within the cavity. One or more electrically-conductive magnetic pole members are movably disposed within the cavity, with a magnet being secured to the pole members for movement therewith. The pole member or members and the magnet are movable in the cavity between a first position in electrical contact with the contact member in order to complete electrical continuity of the electrical circuit, and a second position spaced away from the contact member in order to break electrical continuity of the electrical circuit. A movable and magnetically attractable striker member is disposed for movement toward and away from the switch housing cavity, such as on a pivotal or hinged accessory cover. The magnetic attraction between the magnet (and pole members) and the striker member moves the pole members and the magnet into the second, circuit-breaking position whenever the striker member is moved within a predetermined distance from the cavity.

74 Claims, 5 Drawing Sheets

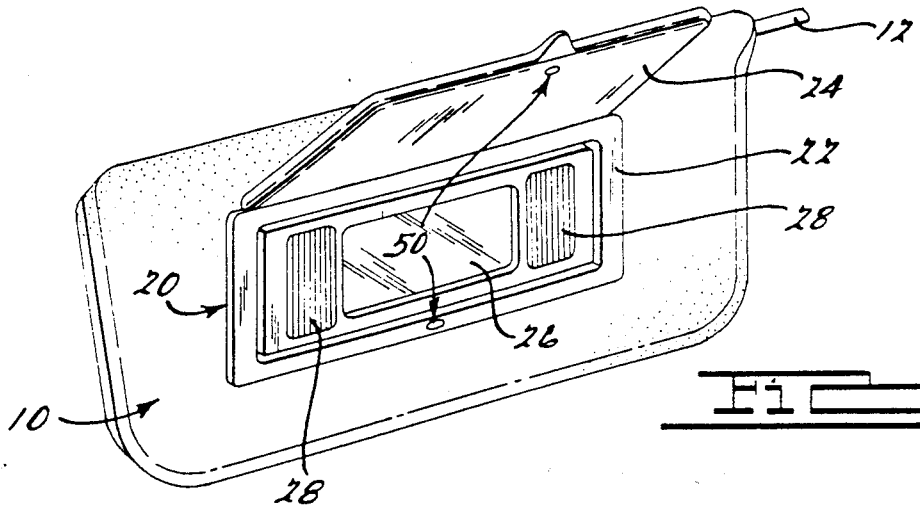
FIG. 1.
FIG. 2.
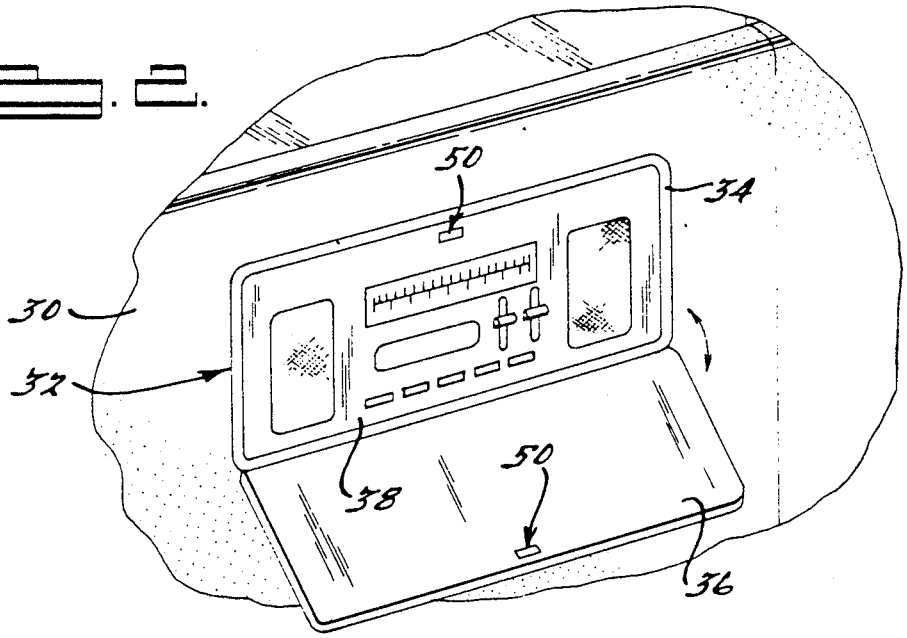
FIG. 3.
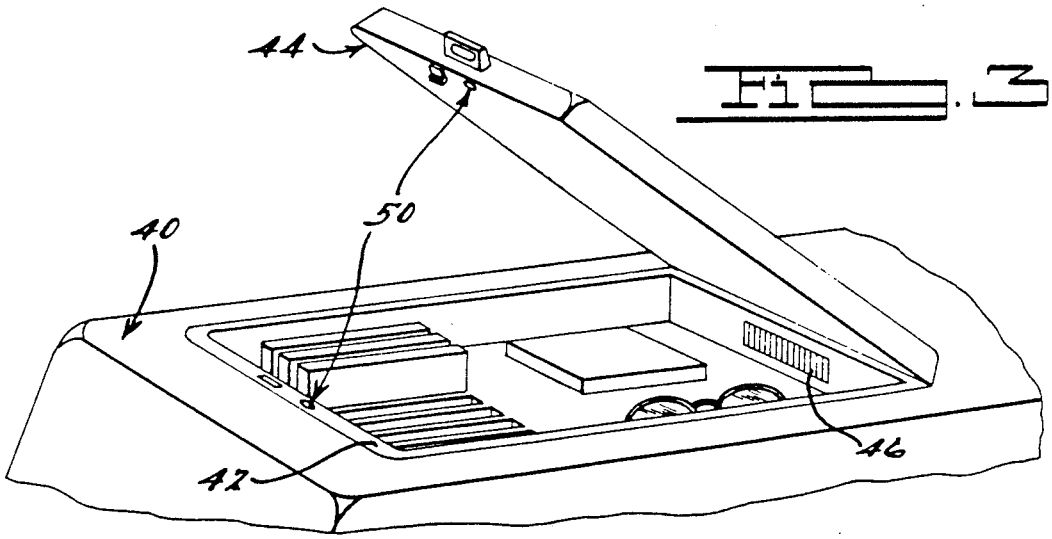

FIG. 12.
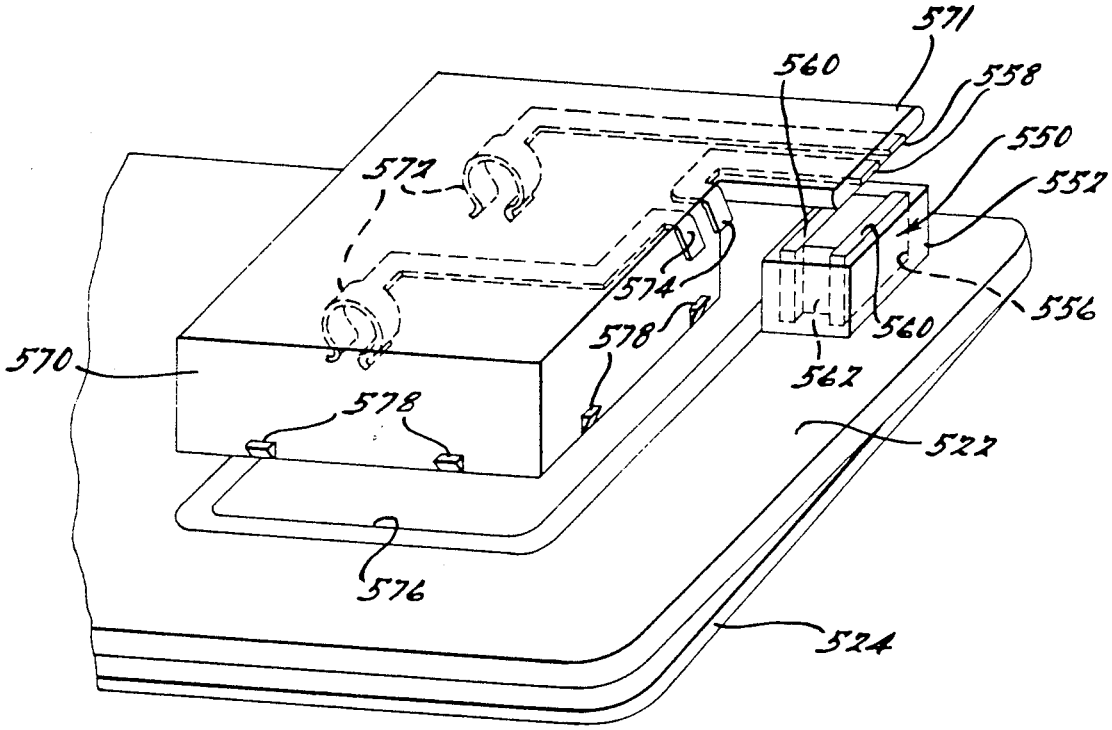
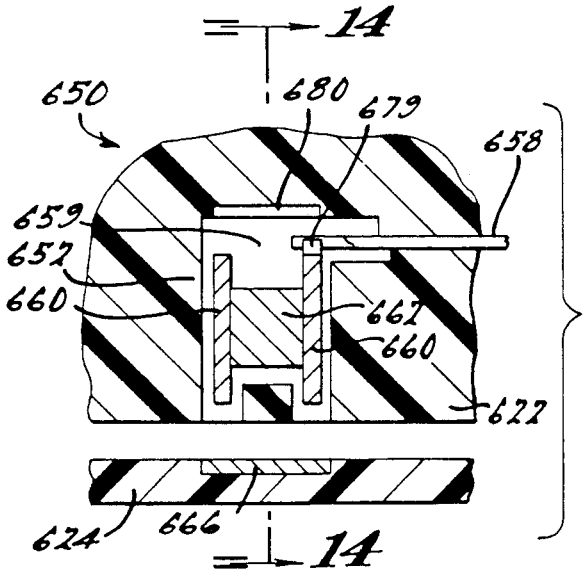
FIG. 13.

MAGNETIC SWITCH AND LATCH FOR VEHICLE ACCESSORIES

BACKGROUND AND SUMMARY OF THE INVENTION

The present invention relates generally to magnetic electrical switching devices, and more particularly to such devices used in vehicle accessory applications. Such magnetic switches according to the present invention can also function as a magnetic latch for holding a movable cover for such a vehicle accessory in either a closed or an open position.

Partially as a result of the current trend of down-sizing vehicles, increased interest and demand has arisen for various vehicle accessories in order to enhance customer satisfaction. Thus, the typical vehicle is equipped with any number of a wide variety of such accessories, many of which include hinged, pivotal, or otherwise movable accessories or accessory doors or covers in the interior, luggage storage areas, engine compartment, or other areas. Such interior accessories include items such as storage compartments, audio, video, or other electronic units, and lighted vanity assemblies, which can be mounted on a vehicle interior side panel, on a headliner or console, or on a vehicle sunvisor, for example. Considerations such as the reduction of vehicle weight for fuel economy, the lowering of manufacturing and installation costs, and enhanced durability and product integrity, have led to the desirability of the reduction in the number of parts in such accessory assemblies, as well as the need for lightweight accessory components that are inexpensive to manufacture and install, and that are both durable and smooth in operation, thus contributing to the value and overall perception of quality associated with such accessories and with the vehicles in which they are installed.

Therefore, in order to address some of these requirements or desired characteristics, the present invention seeks to provide a magnetic switch assembly for an electrical or electronic circuit that is inexpensive and simple to manufacture and install, that has a neat and attractive appearance, and that avoids proliferation and duplicity of parts, especially when such magnetic switch is also employed as a magnetic latch to hold an accessory cover in either a closed or an open position. Thus, according to the present invention, a magnetic switch assembly for an electrical circuit includes a switch housing with a cavity formed therein and at least one magnetically attractable electrical contact member in an exposed disposition within the cavity. One or more electrically-conductive magnetic pole members are movably disposed within the cavity, with a magnet being secured to the pole members for movement therewith. The pole member or members and the magnet are movable in the cavity between a first position, wherein the pole member is in electrical contact with the contact member in order to complete electrical continuity of the electrical circuit, and a second position, wherein the pole member is spaced away from the contact member in order to break electrical continuity of the electrical circuit. The magnetic attraction between the magnet and the contact member tends to magnetically bias the pole member and the magnet into the first, circuit-completing position.

A movable and magnetically attractable striker member is disposed for movement toward and away from the cavity in the switch housing, such as on a pivotal or hinged accessory cover interconnected with an accessory housing, on which the switch housing is disposed. The magnetic attraction between the magnet (and pole members) and the striker member is greater than the magnetic attraction between the magnet (and pole members) and the contact member in order to overcome the magnetic bias of the pole members and the magnet toward the first, circuit-completing position, and to move the pole members and the magnet into the second, circuit-breaking position whenever the striker member is moved within a predetermined distance from the cavity. Optionally, however, the orientations of the components can be reversed, or a repelling magnetic striker plate can be used, such that proximity of the striker plate causes movement into a circuit-completing condition.

Other optional features can be incorporated into the magnetic switch assembly if desired, such as resilient or magnetic assist mechanisms for assisting the movement of the pole member and the magnet toward either of the above-mentioned first and second positions. In addition, in some embodiments of the present invention, the electrical contact member can be deflectable when engaged by the pole member. Such deflectable contact member scrapes or slides against the pole member as the magnet and pole members are moved into and out of the first, circuit-completing position, thereby tending to maintain the contact member in a clean condition.

Additional objects, advantages, and features of the present invention will become apparent from the following description and appended claims, taken in conjunction with the accompanying drawings.

BRIEF DESCRIPTION OF THE DRAWINGS

FIG. 1 is a perspective view of an exemplary sunvisor assembly for the interior of a vehicle, with the visor having a lighted vanity accessory assembly employing a magnetic switch assembly according to the present invention.

FIG. 2 is a partial perspective view of an exemplary vehicle interior side panel having an audio or other electrically-actuated vehicle accessory assembly mounted thereon, and employing a magnetic switch assembly according to the present invention.

FIG. 3 is a partial perspective view of an exemplary vehicle console or arm rest assembly, having a storage compartment and a hinged cover and employing a magnetic switch assembly according to the present invention.

FIG. 12 is a diagrammatic perspective view of a lighted vanity assembly, or other vehicle accessory assembly, illustrating still another variation on the present invention, wherein a magnetic switch assembly according to the present invention is incorporated within a modular, snap-in lamp subassembly or other electrical device.

FIG. 13 is a diagrammatic cross-sectional view similar to that of FIGS. 4 through 6, 8 and 10, but illustrating still another embodiment of the present invention, incorporating a feature by which the electrical contacts are continuously cleaned during use.

DETAILED DESCRIPTION OF THE PREFERRED EMBODIMENTS

Figure 4:
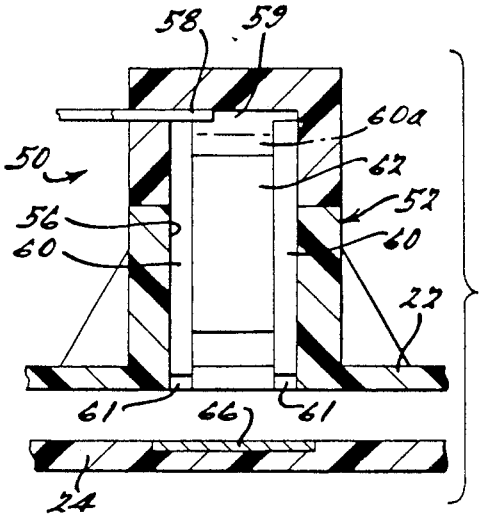
FIG. 4 is a diagrammatic cross-sectional view of one of the preferred embodiments of a magnetic switch assembly according to the present invention.

FIGS. 1 through 18 illustrate various embodiments of magnetic switch assemblies according to the present invention, which are shown incorporated in exemplary applications, including lighted vanity assemblies adapted for mounting on sunvisors or other vehicle interior panels or members, but are equally applicable for other applications as well. One skilled in the art will readily recognize from the following discussion, the appended claims, and the accompanying drawings herein, however, that the principles of the present invention are equally applicable to magnetic switch assemblies other than those shown in FIGS. 1 through 10 for purposes of illustration herein, as well as in other vehicular or non-vehicular applications. In addition, as will become apparent from the following discussion, the principles of the present invention are equally applicable whether the magnetic switch assembly is used only as a switching device, or is used both as a switching device and as a magnetic latch for a hinged, pivotal, or otherwise movable member. It should also be stressed that although the magnets and pole members in the various exemplary embodiments illustrated herein are shown as being mounted on a relatively fixed vehicle accessory housing, with the striker member being mounted on a movable cover, one skilled in the art will readily recognize that such orientation can optionally be reversed, with the striker member being interconnected with a relatively fixed accessory housing and the magnet and pole members being disposed on a movable cover.

FIG. 1 illustrates an exemplary sunvisor 10 pivotally interconnected with a pivot rod 12 that is adapted for being secured in the interior of a vehicle (not shown). A vanity assembly 20 is mounted on one side of the sunvisor 10 and includes a vanity housing 22 and a hinged vanity cover or door 24 for covering and enclosing a mirror 26 and illumination lights 28, for example.

In FIG. 2, a vehicle interior panel 30 is equipped with a vehicle accessory 32 mounted thereon, which is shown for purposes of illustration in FIG. 2 as an exemplary audio accessory. The vehicle accessory 32 includes an accessory housing 34, and a hinged or pivotal cover or door 36 for enclosing an audio unit 38, for example.

In FIG. 3, another exemplary application of the present invention is illustrated, wherein a console or arm rest assembly 40 includes a storage compartment housing 42 recessed therein, with a hinged or pivotally movable cover or door 44 for closing off the storage compartment. Such a storage compartment can include any of a number of electrically-actuated devices, such as the illumination light 46 shown for purposes of illustration as mounted on a side wall of the storage compartment housing 42.

Any of the exemplary applications shown for purposes of illustration in FIGS. 1 through 3 can advantageously include a magnetic switch assembly 50 according to the present invention, which can be used for magnetically switching on or switching off an electrical circuit, as well as optionally being usable for magnetically latching the cover to the accessory housing or in other positions, where appropriate and desired in a given application. Various exemplary embodiments of, or variations on, the switch assembly 50 are illustrated in FIGS. 4 through 17, as well as being discussed in more detail below.

In FIG. 4, which is a diagrammatic illustration, the exemplary switch assembly 50 includes a switch housing 52 having a cavity 56 formed therein, with at least one, and preferably two, magnetically attractable or attractive electrical contact members 58 exposed within the cavity 56. Such contact members 58 are preferably spaced apart from one another in a generally parallel relationship, with one of the contact members 58 being broken away for clarity in FIG. 4. One or more electrically-conductive pole members 60, which are also capable of conducting or transmitting magnetic flux, are movably disposed within the cavity 56, with the pole members 60 being secured to a permanent magnet 62 such that the pole members 60 and the magnet 62 are movable together within the cavity 56.

The pole members 60 and the magnet 62 are movable within the cavity 56 between a first position, wherein one of the pole members 60 is in electrical contact with the contact members 58 in order to complete electrical continuity of an electrical circuit (not shown). The pole members 60 and the magnet 62 are also movable away from the contact members 58 to a second position spaced away from the contact members 58, thereby breaking or interrupting electrical continuity of the electrical circuit between the contact members 58. Preferably, the magnetic attraction between the magnet 62 and the magnetically attractable contact members 58 tends to magnetically bias the pole members 60 and the magnet 62 into the above-mentioned first position electrically interconnecting the contact members 58.

A striker member 66, which can be either a permanent magnet or a magnetically attractable plate, is secured to the cover or door 24 in the exemplary embodiment illustrated in FIG. 4, and is movable toward and away from the cavity 56 along with the door or cover 24 on an opposite side of the magnet 62 from the contact members 58. Whenever the striker member is moved within a predetermined, relatively close distance from the cavity 56, the magnetic attraction between the magnet 62 and the striker member 66 is greater than the magnetic attraction between the magnet 62 and the contact members 58 thus overcoming the magnetic bias of the pole members 60 and the magnet 62 toward the first, circuit-completing position. Therefore, such magnetic attraction between the magnet 62 and the striker member 66 moves the pole members 60 and the magnet 62 into a second position, spaced away from the contact members 58, thus breaking or interrupting the electrical continuity of the electrical circuit whenever the striker member 66 is moved within such predetermined, relatively close distance from the cavity 56.

In the exemplary embodiment of FIG. 4, the contact members 58 are preferably disposed at an inner end 59 of the cavity 56, and the switch housing 52 preferably includes at least one opening 61 in its outer end, opposite the inner end 59, in order to allow the pole members 60 to be movable outwardly into the opening or openings 61 when the striker member 66 is moved within the above-mentioned predetermined distance from the outer end of the cavity 56. However, such orientation can optionally be reversed in virtually any of the embodiments of the invention such that the proximity of the striker member moves the pole member-and-magnet assembly into a circuit-completing position.

Preferably, both the pole members 60 and the striker member 66 are composed of a magnetic flux-conductive material. Such an arrangement provides for an increased flux path when the striker member 66 is touching, or in close proximity with, the pole members 60, thus enhancing or contributing to the greater magnetic attraction between the magnet 62 and the striker member 66 than between the magnet 62 and the contact members 58. Such enhanced magnetic attraction when the cover or door 24 is at or near its closed position allows for a very positive movement of the magnet 62 and the pole members 60 into the second, circuit-breaking position, as well as optionally serving to magnetically "latch" the cover or door 24 in its closed position in appropriate applications. In this regard, it should be noted that in any of the embodiments of the invention the cover or door 24 can also be "latched" in positions other than its closed position by merely positioning a magnetically attractable member or another permanent magnet adjacent such other position.

Although FIG. 4 and other of the drawing figures illustrate one or more openings 61, as discussed above, any of the embodiments of the invention can optionally include a closed outer end, covered by a suitable material, such as a plastic for example. In such an instance, however, the magnetic attraction between the striker plate and the magnet must be sufficient to overcome the magnetic "gap" caused by such covering material.

Figure 5:
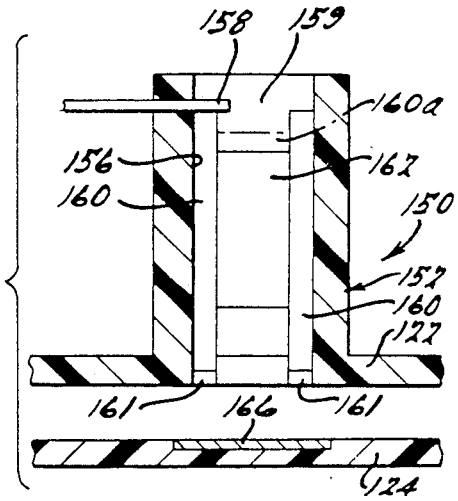
FIG. 5 is a cross-sectional view similar to that of FIG. 4, but illustrating a variation thereon.

FIG. 5 illustrates a variation on the embodiment of FIG. 4, wherein most of the components and elements of the magnetic switch assembly 150 are similar to, or identical with, corresponding components or elements illustrated in FIG. 4. Thus such similar components or elements are indicated by reference numerals similar to those of corresponding components or elements in FIG. 4, but having one-hundred prefixes. In the switch assembly 150 of FIG. 5, however, the inner end 159 of the cavity 156 in the switch housing 152 is open, which may provide for a certain amount of economy, as well as ease of assembly, in applications where it is deemed that there is no need or desirability for a sealed or closed switch housing cavity.

Figure 6:
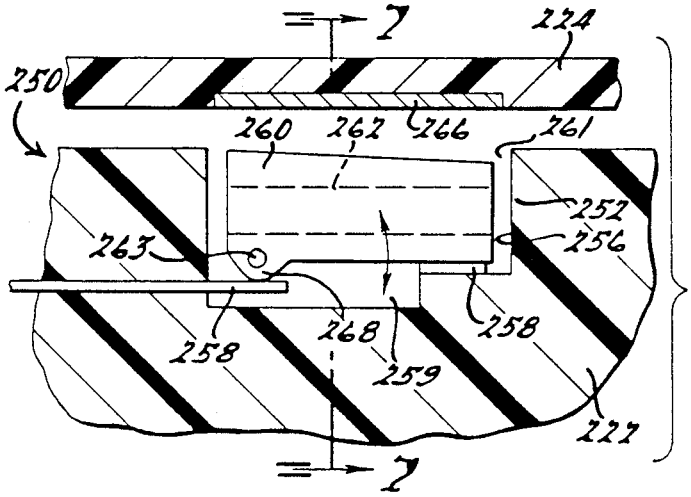
FIG. 6 is a diagrammatic cross-sectional view similar to that of FIGS. 4 and 5, but illustrating another embodiment of the present invention.
Figure 7:
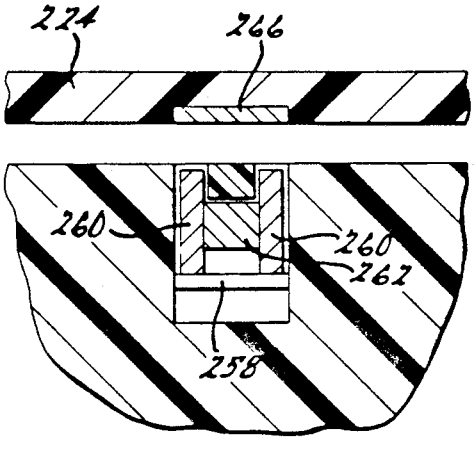
FIG. 7 is a cross-sectional view taken generally along line 7—7 of FIG. 6.

FIGS. 6 and 7 diagrammatically illustrate another version of the present invention, wherein many of the components or elements of the switch assembly 250 are similar, either in configuration or function, to those of the preceding figures. Accordingly, such corresponding components or elements are illustrated by reference numerals similar to those of preceding figures, but having two-hundred prefixes.

In FIGS. 6 and 7, the slidable pole member-and-magnet assembly of the preceding figures is replaced by a magnet 262 and a pair of pole members 260 being pivotally movable about a pivot pin 263 within the cavity 256. An enlarged, generally arcuate portion 268 of the pole member 260 surrounds the pivot pin 263 and engages one of the contact members 258, such that when the pole member 260 and the magnet 262 pivot into the circuit-connecting position illustrated in FIGS. 6 and 7, at least one of the pole members 260 electrically contacts and interconnects both of the contact members 258. In a manner similar to that discussed above in FIGS. 4 and 5, the magnetic attraction between the striker member 266 and the magnet 262 is greater than the magnetic attraction or bias between the magnet 262 and the contact members 258 when the striker member is moved within a predetermined distance in close proximity to the cavity 256, thus causing the pole member 260 and the magnet 262 to pivot away from the magnetically attractable contact member 258 in order to break or interrupt electrical continuity between the two contact members 258. As in the various other embodiments of the present invention shown in the drawings and described herein, the attraction between the striker member 266 and the pole members 260 with the associated magnet 262 can also be employed as a magnetic latch to hold the cover 224 in its closed position in appropriate applications. Other alternate applications of the exemplary configuration of FIGS. 7 and 8 will occur to one skilled in the art, with examples being shown in FIGS. 15 and 16, which are discussed below.

Figure 8:
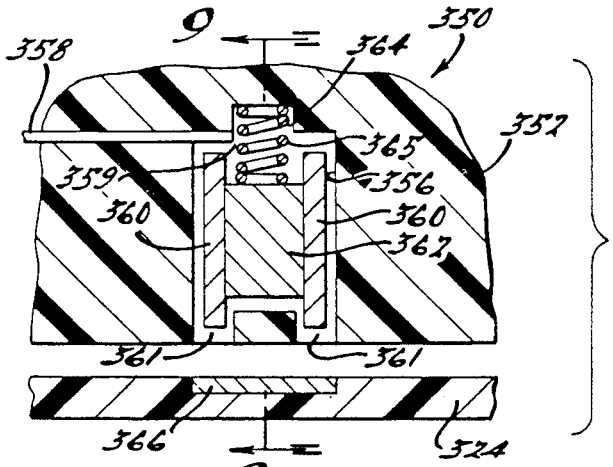
FIG. 8 is a cross-sectional view similar to that of FIGS. 4 through 6, but illustrating still another embodiment of the present invention, wherein a resilient member is used to assist the movement of the magnet and pole members.
Figure 9:
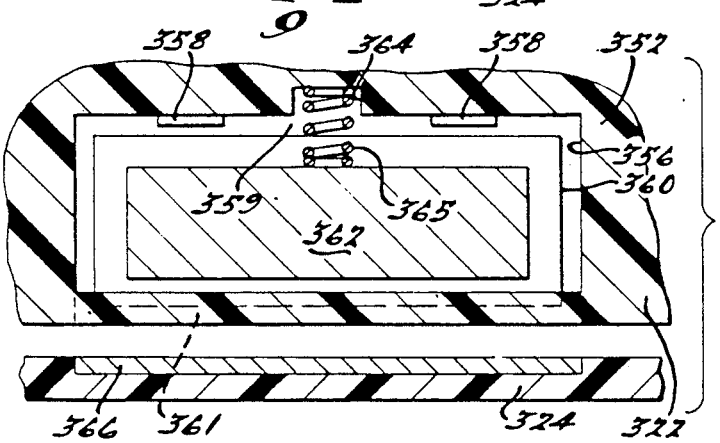
FIG. 9 is a cross-sectional view taken generally along line 9—9 of FIG. 8.

FIGS. 8 and 9 illustrate still another embodiment of the present invention, wherein components and elements of the switch assembly 350 that are similar in function or configuration to those of preceding figures are indicated by similar reference numerals, but having three-hundred prefixes. In FIGS. 7 and 8, the inner end 359 of the cavity 356 is equipped with a recessed portion 364 adapted for receiving a resilient spring or other resilient biasing member 365 therein.

The spring member 365 can be a tension spring that is in greater tension when the pole members 360 and the magnet 362 are in the circuit-breaking position illustrated in FIGS. 7 and 8 than when in a circuit-connecting position with the pole members 360 contacting the contact members 358. In such an arrangement, the resilient biasing means tends to assist the movement of the pole members 360 and the magnet 362 into the first, circuit-connecting position. In this arrangement, the magnetic attraction between the magnet 362 and the striker member 366 is sufficient to overcome both the resilient bias of the spring member 365 and the magnetic attraction between the magnet 362 and the contact members 358 whenever the striker member 366 is moved into a predetermined position in sufficiently close proximity with the cavity 356.

Alternatively, the spring member 365 can be a compression spring that is in greater compression when the magnet 362 and the pole members 360 are in their circuit-connecting position in contact with the contact members 358 than when in the circuit-breaking condition shown in FIGS. 8 and 9, thus providing a resilient assisting force tending to move the pole members 360 and the magnet 362 toward the circuit-interrupting position.

Figure 10:
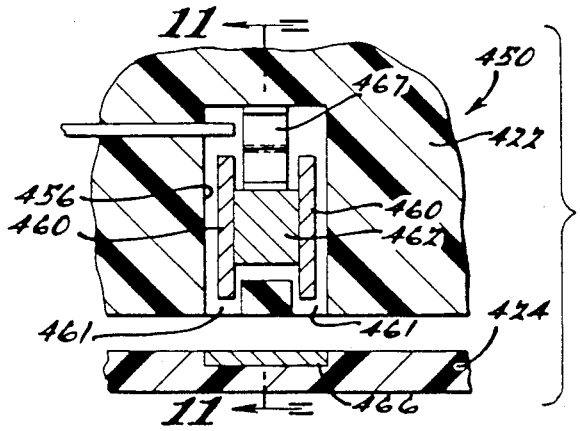
FIG. 10 is a partial cross-sectional view similar to that of FIG. 8, but illustrating a variation thereon.
Figure 11:
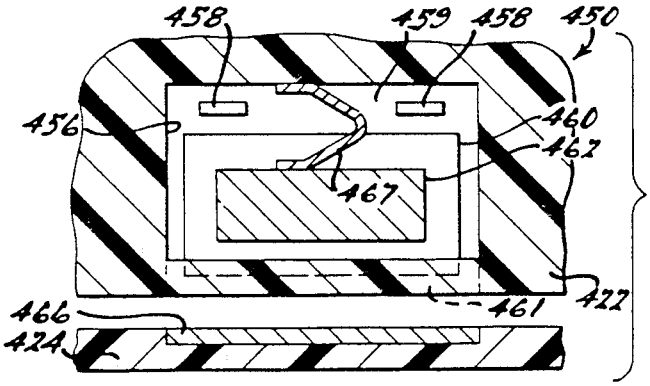
FIG. 11 is a cross-sectional view taken generally along line 11—11 of FIG. 10.

FIG. 10 and 11 illustrate another embodiment of the present invention, wherein the switch assembly 450 is generally similar to the switch assembly 350 illustrated in FIGS. 8 and 9, with corresponding components and elements being indicated by similar reference numerals, but having four-hundred prefixes. In the switch assembly 450 of FIG. 8, however, the spring member 365 is replaced by an exemplary leaf spring member 467, which can be secured to one or both of the pole member-and-magnet assembly and the inner end 459 of the cavity 456. Whether one or both ends of the leaf spring 467 are interconnected with their adjacent components, one skilled in the art will readily recognize that like the spring member 365 in FIGS. 8 and 9, the leaf spring 467 can optionally be used to assist movement of the pole members 460 and the magnet 462 in either of the circuit-opening or circuit-closing directions.

FIG. 12 illustrates still another embodiment of the present invention, wherein a switch assembly 550 includes various components or elements that are similar, either in configuration or function to those shown in preceding figures, and therefore such similar components or elements are indicated by reference numerals that are similar to those of preceding figures, but having five-hundred prefixes. In FIG. 12, a vanity assembly or other accessory assembly is equipped with a housing 570 for receiving a light or other electrically-actuated component, with the light housing 570 having a protruding portion 571 thereon and electrical socket connectors 572 therein. The assembly 550 includes a pair of electrical contacts 558, one of which is directly and electrically interconnected and is preferably an integral extension of one of the power supply terminals 574. The other contact 558 is directly interconnected with, and is preferably a direct extension of, one of the electrical connectors 572 in order to connect the assembly to an electrical load or an electrically operable device and to a source of electrical power. The contacts 558 are preferably carried by, or disposed on, the protruding portion 571. The protruding portion 571 of the lamp housing or module 570 is in turn adapted to overlap and mate with the open cavity 556 in the switch housing 552, thus allowing the switch assembly 550 to function in a manner similar to that described above.

Preferably, the vanity or other vehicle accessory housing 522 includes an opening 576 formed therein and adapted to receive the lamp housing 570 in a snapped-in relationship by way of a number of resilient tabs 578 located about the periphery of the lamp housing 570. The arrangement of FIG. 12 allows for enhanced economy and reduced proliferation of parts in applications where a number of different vehicle accessory assemblies are desired. By providing such an arrangement, a light housing module 570, or other housings or modules for other electrical devices, can be preselected and attached to any of a number of accessory assemblies, thus providing for a wide variety of flexibility and modularization of various accessory assemblies.

Figure 14:
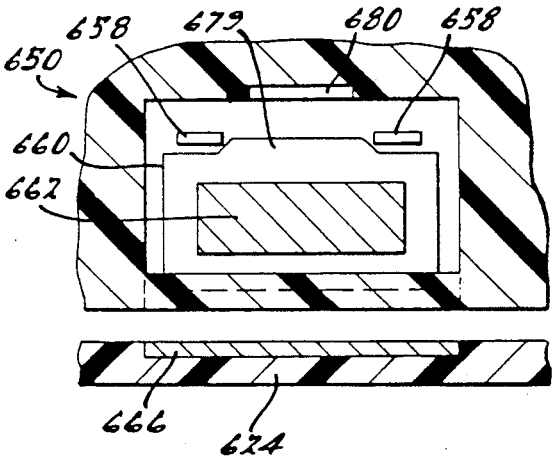
FIG. 14 is a cross-sectional view taken generally along line 14—14 of FIG. 13.

FIGS. 13 and 14 illustrate still another embodiment of the present invention, which like the embodiments shown in the preceding figures, contains many components or elements that are similar, either in configuration or function to those illustrated in the preceding figures and discussed above. Therefore, such similar components or elements are indicated by similar reference numerals, but having six-hundred prefixes in FIGS. 13 and 14.

At least one of the contact members 658 of the switch assembly 650 in FIGS. 13 and 14 are preferably resiliently and laterally movable or resiliently deflectable side-to-side such that they are cammed, ramped, or otherwise forcibly moved outwardly when engaged by a tapered portion 679 of the pole member 660 when the pole member assembly 660 and the magnet 662 move into the circuit-connecting position. In addition to, or in lieu of, such lateral movement or resilient deflection, the contact members 658 can also be movable or deflectable in the direction of movement of the pole member assembly 660 and the magnet 662. Such movement or deflection causes the contact members 658 to scrape or slide against the pole member-and-magnet assembly, thus continually cleaning the contact members 658 as the pole members 660 and the magnet 662 are moved into or out of engagement with the contact members 658. Such sliding or scraping cleaning of the contact members 658 tends to preserve it in a good, electrically-conductive condition and thus may tend to prolong the life and enhance the durability of the switch assembly 650 in applications where such contact-cleaning feature is deemed to be necessary or desirable. Many other versions or geometrical arrangements employing such contact-cleaning feature will occur to those skilled in the art.

In addition, FIGS. 13 and 14 also illustrate another optional variation on the present invention, wherein an assist magnet 680 can be disposed adjacent the inner end 659 of the cavity 656 and can magnetically assist the movement of the pole member assembly 660 and the magnet 662 into the circuit-connecting position in contact with the contact member 658. Alternatively, as will be readily appreciated by those skilled in the art, by appropriately locating the optional magnet 680 in such a way that its polarity is the same as that of the inner end of the pole member-and-magnet assembly, the magnet 680 can be employed to repel the pole member-and-magnet assembly, thus providing for a magnetic assisting force when the pole assembly 660 and the magnet 662 are moved in their circuit opening direction. Such magnetic assist features, as well as the resilient assist features discussed above, can optionally be employed in any of the embodiments of the invention. In this regard any of the exemplary embodiments or features of the invention described herein can optionally be used interchangeably or in conjunction with one another, if desired or necessary in given applications.

Figure 15:
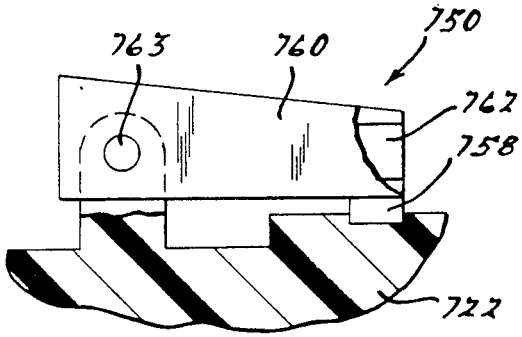
FIGS. 15 and 16 are partial diagrammatic views similar to that of FIG. 4, but illustrating variations thereon.
Figure 16:
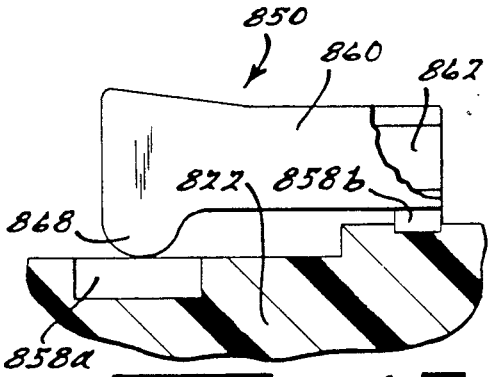

FIGS. 15 and 16 partially illustrate two examples of variations on the arrangement shown in FIGS. 6 and 7, and thus similar or corresponding components or elements are indicated by similar reference numerals, but having seven-hundred prefixes and eight-hundred prefixes, respectively.

In FIG. 15, the pivot pin or rod 763 can be an extension of one electrical conductor and can thus function as an electrical contact, replacing one of the electrical contacts 258 of FIG. 6 and reducing the number of necessary parts. In FIG. 16, however, no pivot pin or rod is needed, with the contact member **858*a* being magnetically attractive or attractable such that the magnetic attraction between the contact member 858*a* and the pole member 860 maintains them in contact even when the striker plate (not shown) is in its closest position. In contrast, the pole member 860 can be separated from the contact member 858*b* by the proximity of the striker plate, as is discussed above, and the arcuate portion 868 merely rolls or slides on the contact member 858***a*.

Figure 17:
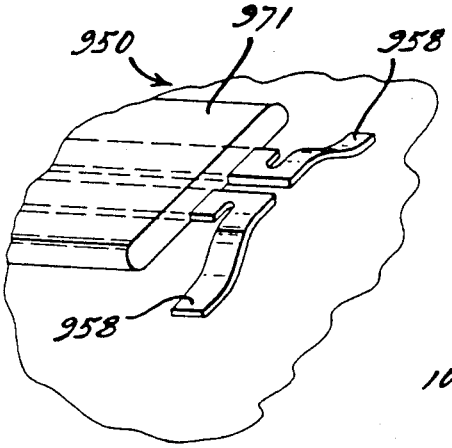
FIG. 17 is a partial perspective view of an exemplary alternate contact arrangement for an assembly according to the present invention.

FIG. 17 partially illustrates an exemplary variation on the arrangement of FIG. 12, discussed above, but also has applicability in various other embodiments of the invention discussed herein. In FIG. 17, the contact members 958 are cantilevered from the protruding portion 971 and are resiliently deflectable in order to achieve the above-mentioned wiping, sliding or scraping motion for purposes of contact cleaning.

Figure 18:
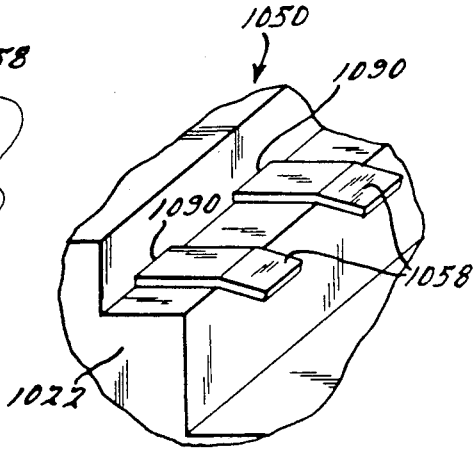
FIG. 18 is a partial perspective view similar to that of FIG. 17, but illustrating still another exemplary variation on a contact arrangement for the present invention.

FIG. 18 partially illustrates still another exemplary variation on a contact arrangement for any of the embodiments of the invention, wherein the contact members 1058 can be cantilevered and can be resiliently deflectable when engaged by the magnetic and pole member assembly (not shown) in order to obtain the above-discussed contact-cleaning function. The contact members 1058 can resiliently deflect about a portion 1090, for example, at which the remainder of the contact members are fixed to the accessory housing 1022 or other portions of the assembly 1050.

The foregoing discussion discloses and describes merely exemplary embodiments of the present invention for purposes of illustration only. One skilled in the art will readily recognize from such discussion, and from the accompanying drawings and claims, that various changes, modifications and variations can be made therein without departing from the spirit and scope of the invention as defined in the following claims.

I claim:

1. A magnetic switch assembly for an electrical circuit, said switch comprising:

a switch housing having a cavity formed therein and at least one magnetically attractable electrical contact member exposed within said cavity;

an electrically-conductive pole member movably disposed within said cavity, said pole member having a magnet secured thereto for movement therewith, said pole member and said magnet being movable in said cavity between a first position wherein said pole member is in electrical contact with said contact member in order to complete electrical continuity of the electrical circuit and a second position wherein said pole member is spaced away from said contact member in order to break electrical continuity of the electrical circuit, the magnetic attraction between said magnet and said contact member tending to magnetically bias said pole member and said magnet into one of said first and second positions; and a movable and magnetically attractable striker member disposed for movement toward and away from said cavity in said switch housing on an opposite side of said magnet from said contact member, the magnetic attraction between said magnet and said striker member being greater than the magnetic attraction between said magnet and said contact member in order to overcome said magnetic bias of said pole member and said magnet toward said one of said first and second positions and to move said pole member and magnet into the other of said first and second positions when said striker member is moved within a predetermined distance from said cavity.

2. A switch assembly according to claim 1, wherein said switch assembly is part of an electrical device having a device housing and a movable cover, said striker member being on one of said device housing and said cover, and said switch housing being on the other of said device housing and said cover, the magnetic attraction between said magnet and said striker member tending to magnetically and releasably latch said cover to said device housing when said striker is moved within said predetermined distance from said cavity.

3. A switch assembly according to claim 1, wherein said contact member is disposed at an inner end of said cavity with respect to said switch housing, said switch housing having at least one opening therein generally at an opposite, outer end of said cavity, said pole member and said magnet being movably disposed between said inner and outer ends of said cavity, a portion of said pole member being movable outwardly into said opening in order to move into said second position when said striker member is moved within said predetermined distance from said outer end of said cavity.

4. A switch assembly according to claim 3, wherein said switch assembly is part of an electrical device having a device housing and a movable cover, said striker plate being on one of said device housing and said cover, and said switch housing being on the other of said device housing and said cover, the magnetic attraction between said magnet and said striker member tending to magnetically latch said cover to said device housing when said cover is moved within said predetermined distance from said device housing.

5. A switch assembly according to claim 1, wherein said pole member and said striker member are each composed of a magnetic flux-conductive material.

6. A switch assembly according to claim 1, wherein a pair of said contact members are disposed within said cavity in a spaced-apart relationship, said pole member being in electrical contact with both of said contact members when in said first position.

7. A switch assembly according to claim 1, wherein said pole member and said magnet are slidably movable within said cavity.

8. A switch assembly according to claim 1, wherein said pole member and said magnet are pivotally movable within said cavity.

9. A switch assembly according to claim 1, further including resilient biasing means tending to resiliently bias said pole member and said magnet into said first position in order to assist the movement of said pole member and said magnet into said first position, said magnetic attraction between said magnet and said striker member being sufficiently great to overcome both said resilient bias and said magnetic bias of said pole member and said magnet into said first position and to move said pole member and said magnet into said second position.

10. A switch assembly according to claim 9, wherein said resilient biasing means includes a tension spring, said tension spring being in greater tension when said pole member and said magnet are in said second position than when in said first position.

11. A switch assembly according to claim 9, wherein said resilient biasing means includes a leaf spring having a relaxed configuration and resiliently deflected configuration, said leaf spring being resiliently deflected from said relaxed configuration to a greater extent when said pole member and said magnet are in said second position than when in said first position.

12. A switch assembly according to claim 1, further including a magnetic assist means tending to magnetically urge said pole member and said magnet into said first position in order to assist the movement of said pole member and said magnet into said first position, said magnetic attraction between said magnet and said striker member being sufficiently great to overcome both said magnetic bias and said magnet assist means of said pole member and said magnet into said first position and to move said pole member and said magnet into said second position when said striker member is moved within said predetermined distance from said cavity.

13. A switch assembly according to claim 1, further including resilient assist means tending to resiliently urge said pole member and said magnet into said second position in order to assist the movement of said pole member and said magnet into said second position, said magnetic attraction between said magnet and said contact member being sufficiently great to overcome said resilient assist means and thereby move said pole member and said magnet into said first position when said striker member is moved more than said predetermined distance from said cavity.

14. A switch assembly according to claim 13, wherein said resilient biasing means includes a tension spring, said tension spring being in greater tension when said pole member and said magnet are in said first position than when in said second position.

15. A switch assembly according to claim 13, wherein said resilient biasing means includes a leaf spring having a relaxed configuration and a resiliently deflected configuration, said leaf spring being resiliently deflected from said relaxed configuration to a greater extent when said pole member and said magnet are in said first position than when in said second position.

16. A switch assembly according to claim 1, further including a magnetic assist means tending to magnetically urge said pole member and said magnetic into said second position in order to assist the movement of said pole member and said magnet into said second position, said magnetic attraction between said magnet and said contact member being sufficiently great to overcome said magnetic assist means and move said pole member and said magnet into said first position when said striker member is moved more than said predetermined distance from said cavity.

17. A switch assembly according to claim 1, wherein said cavity is in a portion of an electric device housing, said electrical contact member being part of the electric circuit for an electric device, said electric device housing being attachable to a first hinged member, and said striker member being attached to a second hinged member hingedly interconnected with said first hinged member for relative hinged movement therebetween.

18. A switch assembly according to claim 17, wherein said electric device housing and said first hinged member include attachment means thereon for allowing said electric device housing to be snapped into attachment with said first hinged member.

19. A switch assembly according to claim 1, wherein said contact member is in an electric device housing distinct from said switch housing, said contact member being part of the electric circuit for an electric device, said switch housing being interconnected with a first hinged member, said electric device housing being attachable to first hinged member with said contact member aligned with, and exposed within, said cavity, said striker member being attached to a second hinged member hingedly interconnected with said first hinged member for relative hinged movement therebetween.

20. A switch assembly according to claim 19, wherein said electric device housing and said first hinged member include attachment means thereon for allowing said electric device housing to be snapped into attachment with said first hinged member.

21. A switch assembly according to claim 1, wherein said contact member is resiliently deflectable, said pole member having a portion thereon for engaging said contact member when said pole member and said magnet are moved into said first position, said engagement with said portion of said pole member causing said contact member to deflectably and slidably engage said pole member when in said first position in order to tend to slidably clean said contact member.

22. A switch assembly according to claim 1, wherein said pole member is engageable with said striker member when said striker member is moved within said predetermined distance from said cavity.

23. A switch assembly according to claim 1, further including a relatively thin plate portion of said switch housing positioned between said pole member and said striker member in order to substantially cover said pole member and said magnet.

24. A switch assembly according to claim 1, wherein said switch assembly is housed in a lighted vanity assembly, said vanity assembly being mounted on an automotive sunvisor.

25. A switch assembly according to claim 24, wherein said vanity assembly includes a vanity housing and a vanity cover member hingedly interconnected with said vanity housing, said switch housing being on one of said vanity cover member and said vanity housing, and said striker member being on the other of said vanity cover member and said vanity housing.

26. A magnetic switch assembly for an electrical circuit in a vehicle accessory, said vehicle accessory having a cover member interconnected with an accessory housing for movement relative thereto, said switch comprising:

a switch housing disposed on one of the cover member and the accessory housing, said switch housing having a cavity formed therein and at least one magnetically attractable electrical contact member exposed within said cavity;

an electrically-conductive pole member movable disposed within said cavity, said pole member having a magnet secured thereto for movement therewith, said pole member and said magnet being movable in said cavity between a first position wherein said pole member is in electrical contact with said contact member in order to complete electrical continuity of the electrical circuit and a second position wherein said pole member is spaced away from said contact member in order to break electrical continuity of the electrical circuit, the magnetic attraction between said magnet and said contact member tending to magnetically bias said pole member and said magnet into one of said first and second positions; and a movable and magnetically attractable striker member disposed on the other of the cover member and the accessory housing for movement therewith toward and away from said cavity in said switch housing on an opposite side of said magnet from said contact member, the magnetic attraction between said magnet and said striker member being greater than the magnetic attraction between said magnet and said contact member in order to overcome said magnetic bias of said pole member and said magnet toward said one of said first and second positions and to move said pole member and magnet into the other of said first and second positions when the cover member is moved within a predetermined distance from the accessory housing.

27. A switch assembly according to claim 26, wherein the magnetic attraction between said magnet and said striker member tends to magnetically and releasably latch said cover member to said accessory housing when said striker is moved within said predetermined distance from said cavity.

28. A switch assembly according to claim 26, wherein said contact member is disposed at an inner end of said cavity with respect to said switch housing, said switch housing having at least one opening therein generally at an opposite, outer end of said cavity, said pole member and said magnet being movably disposed between said inner and outer ends of said cavity, a portion of said pole member being movable outwardly into said opening in order to move into said second position when said striker member is moved within said predetermined distance from said outer end of said cavity.

29. A switch assembly according to claim 28, wherein the magnetic attraction between said magnet and said striker member tends to magnetically and releasably latch said cover member to said accessory housing when said striker is moved within said predetermined distance from said cavity.

30. A switch assembly according to claim 26, wherein said pole member and said striker member are each composed a magnetic flux-conductive material.

31. A switch assembly according to claim 26, wherein a pair of said contact members are disposed within said cavity in a spaced-apart relationship, said pole member being in electrical contact with both of said contact members when in said first position.

32. A switch assembly according to claim 26, wherein said pole member and said magnet are slidably movable within said cavity.

33. A switch assembly according to claim 26, wherein said pole member and said magnet are pivotally movable within said cavity.

34. A switch assembly according to claim 26, further including resilient biasing means tending to resiliently bias said pole member and said magnet into said first position in order to assist the movement of said pole member and said magnet into said first position, said magnetic attraction between said magnet and said striker member being sufficiently great to overcome both said resilient bias and said magnetic bias of said pole member and said magnet into said first position and to move said pole member and said magnet into said second position.

35. A switch assembly according to claim 34, wherein said resilient biasing means includes a tension spring, said tension spring being in greater tension when said pole member and said magnet are in said second position than when in said first position.

36. A switch assembly according to claim 34, wherein said resilient biasing means includes a leaf spring having a relaxed configuration and a resiliently deflected configuration, said leaf spring being resiliently deflected from said relaxed configuration to a greater extent when said pole member and said magnet are in said second position than when in said first position.

37. A switch assembly according to claim 26, further including a magnetic assist means tending to magnetically urge said pole member and said magnet into said first position in order to assist the movement of said pole member and said magnet into said first position, said magnetic attraction between said magnet and said striker member being sufficiently great to overcome both said magnetic bias and said magnetic assist means of said pole member and said magnet into said first position and to move said pole member and said magnet into said second positon when said striker member is moved within said predetermined distance from said cavity.

38. A switch assembly according to claim 26, further including resilient assist means tending to resiliently urge said pole member and said magnet into said second position in order to assist the movement of said pole member and said magnet into said second position, said magnetic attraction between said magnet and said contact member being sufficiently great to overcome said resilient assist means and thereby move said pole member and said magnet into said first position when said striker member is moved more than said predetermined distance from said cavity.

39. A switch assembly according to claim 38, wherein said resilient biasing means includes a tension spring, said tension spring being in greater tension when said pole member and said magnet are in said first position than when in said second position.

40. A switch assembly according to claim 38, wherein said resilient biasing means includes a leaf spring having a relaxed configuration and a resiliently deflected configuration, said leaf spring being resiliently deflected from said relaxed configuration to a greater extent when said pole member and said magnet are in said first position than when in said second position.

41. A switch assembly according to claim 26, further including a magnetic assist means tending to magnetically urge said pole member and said magnet into said second position in order to assist the movement of said pole member and said magnet into said second position, said magnetic attraction between said magnet and said contact member being sufficiently great to overcome said magnetic assist means and move said pole member and said magnet into said first position when said striker member is moved more than said predetermined distance from said cavity.

42. A switch assembly according to claim 26, wherein said cavity is in a portion of an electric device housing, said electrical contact member being part of the electric circuit for an electric device, said electric device housing being attached to said one of the cover member and the accessory housing, the cover member being hingedly interconnected with the accessory housing for relative hinged movement therebetween.

43. A switch assembly according to claim 42, wherein said electric device housing and said one of the cover member and the accessory housing include attachment means thereon for allowing said electric device housing to be snapped into attachment with said one of the cover member and the accessory housing.

44. A switch assembly according to claim 26, wherein said contact member is in an electric device housing distinct from said switch housing and said one of the cover member and the accessory housing, said contact member being part of the electric circuit for an electric device, said switch housing being interconnected with said one of the cover member and the accessory housing, said electric device housing being attachable to said one of the cover member and the accessory housing with said contact member aligned with, and exposed within, said cavity, the the cover member being hingedly interconnected with the accessory housing for relative hinged movement therebetween.

45. A switch assembly according to claim 44, wherein said electric device housing and said one of the cover member and the accessory housing include attachment means thereon for allowing said electric device housing to be snapped into attachment with said one of the cover member and the accessory housing.

46. A switch assembly according to claim 26, wherein said contact member is resiliently deflectable, said pole member having a portion thereon for engaging said contact member when said pole member and said magnet are moved into said first position, said engagement with said portion of said pole member causing said contact member to deflectably and slidably engage said pole member when in said first position in order to tend to slidably clean said contact member.

47. A switch assembly according to claim 26, wherein said pole member is engageable with said striker member when said striker member is moved within said predetermined distance from said cavity.

48. A switch assembly according to claim 26, further including a relatively thin plate portion of said switch housing positioned between said pole member and said striker member in order to substantially cover said pole member and said magnet.

49. A magnetic switch assembly for an electrical circuit in a vanity assembly having a vanity housing adapted to be attached to a vehicle interior member and a vanity cover member interconnected with the vanity housing for movement relative thereto, said switch comprising:

a switch housing disposed on one of the vanity cover member and the vanity housing, said switch housing having a cavity formed therein and at least one magnetically attractable electrical contact member exposed within said cavity;

an electrically-conductive pole member movably disposed within said cavity, said pole member having a magnet secured thereto for movement therewith, said pole member and said magnet being movable in said cavity between a first position wherein said pole member is in electrical contact with said contact member in order to complete electrical continuity of the electrical circuit and a second position wherein said pole member is spaced away from said contact member in order to break electrical continuity of the electrical circuit, the magnetic attraction between said magnet and said contact member tending to magnetically bias said pole member and said magnet into one of said first and second positions; and a movable and magnetically attractable striker member disposed on the other of the vanity cover member and the vanity housing for movement therewith toward and away from said cavity in said switch housing on an opposite side of said magnet from said contact member, the magnetic attraction between said magnet and said striker member being greater than the magnetic attraction between said magnet and said contact member in order to overcome said magnetic bias of said pole member and said magnet toward said one of said first and second positions and to move said pole member and magnet into the other of said first and second positions when the vanity cover member is moved within a predetermined distance from the vanity housing.

50. A switch assembly according to claim 49, wherein the magnetic attraction between said magnet and said striker member tends to magnetically and releasably latch said vanity cover member to said vanity housing when said striker is moved within said predetermined distance from said cavity.

51. A switch assembly according to claim 49, wherein the vehicle interior member is a vehicle interior panel.

52. A switch assembly according to claim 49, wherein the vehicle interior member is a sunvisor.

53. A switch assembly according to claim 49, wherein the vehicle interior member is a portion of a vehicle seat.

54. A switch assembly according to claim 49, wherein said contact member is disposed at an inner end of said cavity with respect to said switch housing, said switch housing having at least one opening therein generally at an opposite, outer end of said cavity, said pole member and said magnet being movably disposed between said inner and outer ends of said cavity, a portion of said pole member being movable outwardly into said opening in order to move into said second position when said striker member is moved within said predetermined distance from said outer end of said cavity.

55. A switch assembly according to claim 54, wherein the magnetic attraction between said magnet and said striker member tends to magnetically and releasably latch said vanity cover member to said vanity housing when said striker is moved within said predetermined distance from said cavity.

56. A switch assembly according to claim 49, wherein said pole member and said striker member are each composed of a magnetic flux-conductive material.

57. A switch assembly according to claim 49, wherein a pair of said contact members are disposed within said cavity in a spaced-apart relationship, said pole member being in electrical contact with both of said contact members when in said first position.

58. A switch assembly according to claim 49, wherein said pole member and said magnet are slidably movable within said cavity.

59. A switch assembly according to claim 49, wherein said pole member and said magnet are pivotally movable within said cavity.

60. A switch assembly according to claim 49, further including resilient biasing means tending to resiliently bias said pole member and said magnet into said first position in order to assist the movement of said pole member and said magnet into said first position, said magnetic attraction between said magnet and said striker member being sufficiently great to overcome both said resilient bias and said magnetic bias of said pole member and said magnet into said first position and to move said pole member and said magnet into said second position.

61. A switch assembly according to claim 60, wherein said resilient biasing means includes a tension spring, said tension spring being in greater tension when said pole member and said magnet are in said second position than when in said first position.

62. A switch assembly according to claim 60, wherein said resilient biasing means includes a leaf spring having a relaxed configuration and a resiliently deflected configuration, said leaf spring being resiliently deflected from said relaxed configuration to a greater extent when said pole member and said magnet are in said second position than when in said first position.

63. A switch assembly according to claim 49, further including a magnetic assist means tending to magnetically urge said pole member and said magnet into said first position in order to assist the movement of said pole member and said magnet into said first position, said magnetic attraction between said magnet and said striker member being sufficiently great to overcome both said magnetic bias and said magnetic assist means of said pole member and said magnet into said first position and to move said pole member and said magnet into said second position when said striker member is moved within said predetermined distance from said cavity.

64. A switch assembly according to claim 49, further including resilient assist means tending to resiliently urge said pole member and said magnet into said second position in order to assist the movement of said pole member and said magnet into said second position, said magnetic attraction between said magnet and said contact member being sufficiently great to overcome said resilient assist means and thereby move said pole member and said magnet into said first position when said striker member is moved more than said predetermined distance from said cavity.

65. A switch assembly according to claim 64, wherein said resilient biasing means includes a tension spring, said tension spring being in greater tension when said pole member and said magnet are in said first position than when in said second position.

66. A switch assembly according to claim 64, wherein said resilient biasing means includes a leaf spring having a relaxed configuration and a resiliently deflected configuration, said leaf spring being resiliently deflected from said relaxed configuration to a greater extent when said pole member and said magnet are in said first position than when in said second position.

67. A switch assembly according to claim 49, further including a magnetic assist means tending to magnetically urge said pole member and said magnet into said second position in order to assist the movement of said pole member and said magnet into said second position, said magnetic attraction between said magnet and said contact member being sufficiently great to overcome said magnetic assist means and move said pole member and said magnet into said first position when said striker member is moved more than said predetermined distance from said cavity.

68. A switch assembly according to claim 49, wherein said cavity is in a portion of an electric light housing, said electrical contact member being part of the electric circuit for an electric light, said electric light housing being attached to said one of the vanity cover member and the vanity housing, the vanity cover member being hingedly interconnected with the vanity housing for relative hinged movement therebetween.

69. A switch assembly according to claim 68, wherein said electric light housing and said one of the vanity cover member and the vanity housing include attachment means thereon for allowing said electric light housing to be snapped into attachment with said one of the vanity cover member and the vanity housing.

70. A switch assembly according to claim 49, wherein said contact member is in an electric light housing distinct from said switch housing and said one of the vanity cover member and the vanity housing, said contact member being part of the electric circuit for an electric light, said switch housing being interconnected with said one of the vanity cover member and the vanity housing, said electric light housing being attachable to said one of the vanity cover member and the vanity housing with said contact member aligned with, and exposed within, said cavity, the vanity cover member being hingedly interconnected with the accessory housing for relative hinged movement therebetween.

71. A switch assembly according to claim 70, wherein said electric light housing and said one of the vanity cover member and vanity housing include attachment means thereon for allowing said electric light housing to be snapped into attachment with said one of the vanity cover member and the vanity housing.

72. A switch assembly according to claim 49, wherein said contact member is resiliently deflectable, said pole member having a portion thereon for engaging said contact member when said pole member and said magnet are moved into said first position, said engagement with said portion of said pole member causing said contact member to deflectably and slidably engage said pole member when in said first position in order to tend to slidably clean said contact member.

73. A switch assembly according to claim 49, wherein said pole member is engageable with said striker member when said striker member is moved within said predetermined distance from said cavity.

74. A switch assembly according to claim 49, further including a relatively thin plate portion of said switch housing positioned between said pole member and said striker member in order to substantially cover said pole member and said magnet.

* * * * *

UNITED STATES PATENT AND TRADEMARK OFFICE

CERTIFICATE OF CORRECTION

PATENT NO. : 4,999,599

DATED : March 12, 1991

INVENTOR(S) : Eric A. Spier

It is certified that error appears in the above-identified patent and that said Letters Patent is hereby corrected as shown below:

Column 7, line 3, "FIG." should be --FIGS.--.

Column 10, line 61, after "and" insert --a--.

Column 11, line 35, "magnetic" should be --magnet--.

Column 12, line 45, "movable" should be --movably--.

Column 15, line 4, delete "the", second occurrence.

Signed and Sealed this

Fifteenth Day of December, 1992

*Attest:*

DOUGLAS B. COMER

*Attesting Officer*

*Acting Commissioner of Patents and Trademarks*